United States Patent [19]

Kane

[11] Patent Number: 4,479,639

[45] Date of Patent: Oct. 30, 1984

[54] TOOL FOR POSITIONING ELECTRIC OUTLET BOXES

[76] Inventor: Michael W. Kane, 2712 - 65th Ave. North, Minneapolis, Minn. 55430

[21] Appl. No.: 429,510

[22] Filed: Sep. 30, 1982

[51] Int. Cl.[3] ..... B25B 21/20

[52] U.S. Cl. ..... 269/6; 33/180 R; 33/DIG. 10; 269/238; 269/254 R; 269/904

[58] Field of Search ..... 269/3, 6, 904, 238, 269/254 R, 257, 81; 81/419, 427; 33/174 R, 180 R, DIG. 10

[56] References Cited

U.S. PATENT DOCUMENTS

| | | | |
|---|---|---|---|
| 326,909 | 9/1885 | Kricker | 81/419 |
| 1,465,429 | 8/1923 | Gasparaitis | 81/419 |
| 2,273,843 | 2/1942 | Dougherty | 81/419 |
| 2,956,798 | 10/1960 | Briggs . | |
| 3,154,304 | 10/1964 | Crawford . | |
| 3,321,736 | 5/1967 | Flynn | 81/419 |
| 3,436,070 | 4/1969 | Utley et al. . | |
| 3,601,386 | 8/1971 | Estep . | |
| 3,617,044 | 11/1971 | Strange . | |
| 3,678,588 | 7/1972 | Isola et al. . | |
| 3,875,669 | 4/1975 | Hull . | |
| 4,181,295 | 1/1980 | Duffy . | |

*Primary Examiner*—Robert C. Watson

*Attorney, Agent, or Firm*—Kinney & Lange

[57] ABSTRACT

A tool for holding and positioning an electrical junction box includes a pair of handles pivotally connected in a lever arrangement so that squeezing together the grip portions of the handles urges apart the jaw portions of the handles. A spring biases the jaw portions together. A first jaw portion has a flat surface for contacting an outside of a wall electrical junction box. A second jaw portion has two spaced apart fingers for contacting an inside surface of the wall of the junction box so that the jaw portions grip the wall in a three-point connection. The first jaw portion has a sliding adjustable plate for contacting the face of a wall stud or ceiling joist to set the distance from that face that the front edge of the wall of the junction box will be positioned.

5 Claims, 7 Drawing Figures

TOOL FOR POSITIONING ELECTRIC OUTLET BOXES

BACKGROUND OF THE INVENTION

1. Field of the Invention.

This invention relates to tools for positioning electrical outlet boxes for installation on building framing members.

2. Description of the Prior Art.

Electrical boxes are commonly attached to wall studs or ceiling joists in building frames before the wall covering, such as sheet rock or paneling, is installed. For the face of the electrical box to be flush with the surface of the finished wall, the box must be offset forward of the face of the wall stud or ceiling joist. For example, if TM inch sheet rock were to be later installed, the front edge of the electrical box must be spaced out TM inches from the face of the wall studs.

To do a workman-like and esthetically pleasing job, the electrician should also position all wall outlet fixtures an equal distance from the floor. It is difficult to properly position an electrical box to get exact measurements for both these parameters. Proper positioning also slows down the installation process and reduces the productivity of the electrician.

Many attempts have been made to find a satisfactory tool for accomplishing this positioning. The following seven patents relate to tools for locating electrical boxes:

| Inventor | U.S. Pat. No. | Issue Date |
|---|---|---|
| Briggs | 2,956,798 | 10/18/60 |
| Crawford | 3,154,304 | 10/27/64 |
| Utley et al | 3,436,070 | 01/01/69 |
| Estep | 3,601,386 | 08/24/71 |
| Strange | 3,617,044 | 11/02/71 |
| Isola et al | 3,678,588 | 07/25/72 |
| Hull | 3,875,669 | 04/08/75 |
| Duffy | 4,181,295 | 01/01/80 |

U.S. Pat. No. 3,678,588 to Isola et al discloses a wall outlet box locator apparatus for tracing a cut-out area in a wall panel for an outlet box. This does not appear particularly related to the present invention.

U.S. Pat. No. 3,154,304 to Crawford discloses a box tool which holds rectangular boxes for positioning against the wall stud. A clip mounts the tool on a wall stud. The tool includes a pair of clips for frictionally bearing against the inside of the box.

U.S. Pat. No. 3,436,070 to Utley et al discloses a jig for holding an electrical outlet box to a wall stud. The jig includes a pair of plates for holding the outlet box. A pole on the jig extends to contact the floor to properly position the height of the box.

U.S. Pat. No. 3,875,669 to Hull also discloses apparatus for holding an outlet box in position against a wall stud. It also uses an extending rod to set the distance from the floor. A pair of lips extending out from a plate holds the box to the apparatus.

U.S. Pat. No. 2,956,798 to Briggs discloses a hand tool for positioning an electrical box which has an adjustable rod for contacting the floor to set the height of the box. The tool includes a plate which contacts the wall stud. An adjustable stop sets the distance of the electrical box from the face of the wall stud. The box is held by a spring clip extending inside the box.

U.S. Pat. No. 3,601,386 to Estep discloses a pair of tongs with a plate on each jaw of the tongs for gripping a wall of an electrical box. Each plate has an enlarged front area for contacting the wall stud to set the distance from the front of the box to the wall stud. The distance is adjustable by setting pins in holes through the plates. The front edge of the box hits one of the pins to set its distance from the enlarged area of the plate. The tool also has an adjustable rod for determining distance from the floor.

U.S. Pat. No. 3,617,044 to Strange discloses lockable pliers having plates mounted on the jaws for gripping the wall of an electrical box. One plate has a portion adapted for contacting the face of a wall stud to set the distance from the edge of the box to the wall stud. The distance is adjustable by a slidably mounted guide bar on the plate.

U.S. Pat. No. 4,181,295 to Duffy discloses a box holder with a pair of spring clips to slide inside the wall of a rectangular box to hold it for positioning against a wall stud.

All of the prior art tools discussed above are designed to operate on traditional rectangular boxes. What is needed is a universal tool that can clamp on all types of electrical boxes, whether rectangular, square, or round. For example, lighting outlet boxes in ceilings are commonly circular in cross section. These round boxes cannot be gripped easily by any of the prior art devices. Modern plastic boxes often have tubular interior elements mounted in the box walls which are tapped to allow plates to be screwed on the face of the box. These interior appurtenances get in the way of prior art gripping devices. To solve the problems in the prior art a tool must firmly grasp an electrical box without continued hand pressure from an electrician, so that the box can be nailed to the wall stud or ceiling joist without disturbing either the grip on the box or the distance that the box is spaced from the face of the stud or joist.

SUMMARY OF THE INVENTION

A tool for positioning an electrical box for attachment to a building framing member includes a first jaw element and a second jaw element. The first jaw element includes a plate for contacting an outside surface on a wall of an electrical box. The second jaw element has two spaced apart fingers for contacting an inside surface of the wall of the electrical box, so that when the jaw elements are closed on the wall, they grip the wall in a three-point connection. The tool includes means to bias the first and second jaw elements together to grip the wall.

A stop means mounted on one jaw element contacts a facing edge of the wall of the electrical box. A spacer plate on the jaw element contacts a face of a building framing member, such as a wall stud or ceiling joist, to determine the relative position of the face of the framing member and the face of the facing edge of the wall of the box when the box is positioned adjacent a side of the framing member.

The means to bias together the first and second jaw elements is preferably first and second handles which are pivotally attached in a lever arrangement so that moving grip portions of the handles together moves jaw portions apart. A spring preferably biases the grip portions apart.

The first jaw element has a first surface and the spacer plate preferably has a leg with a second surface. The first and second surfaces are in sliding contact.

Adjustment means preferably includes protruberances, such as pins, on one of the surfaces and matching recesses or holes on the other surface, so that the protuberances engage the recesses in a finite number of fixed positions. Adjustment means preferably include a threaded bolt mounted through the leg to threadably engage the jaw element to tighten the surfaces and close contact.

The tool also preferably includes a U-shaped clip mounted on one jaw element for receiving a measuring rod for determining distance from the floor that the electrical box is to be positioned.

DETAILED DESCRIPTION OF THE PREFERRED EMBODIMENTS

Figure 1:
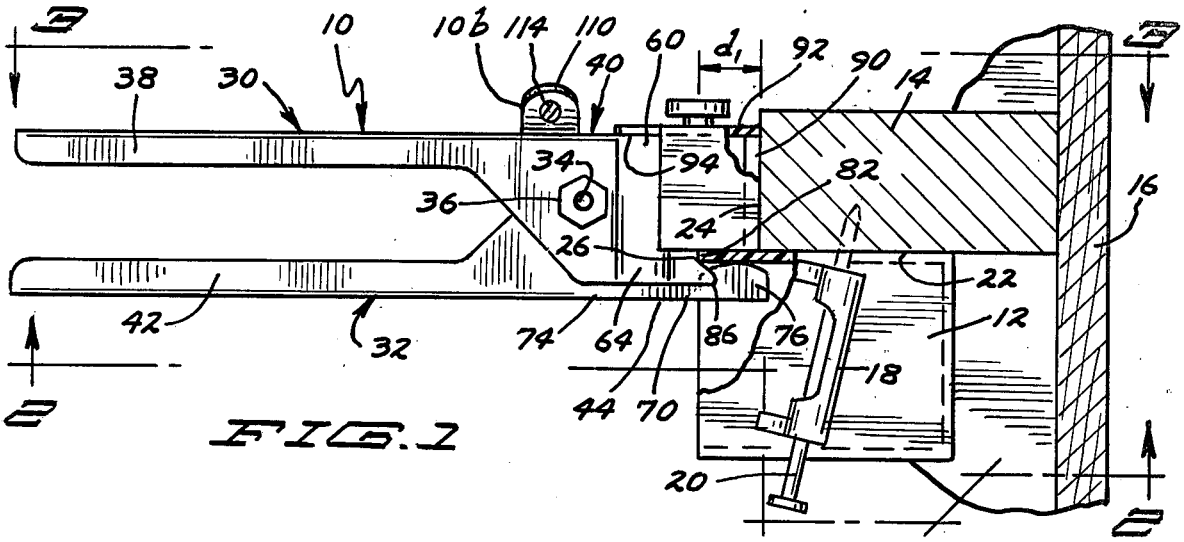
FIG. 1 is an elevational view of a box positioning tool constructed according to the present invention and shown gripping a box in position against a wall stud which is shown in cross section.
Figure 2:
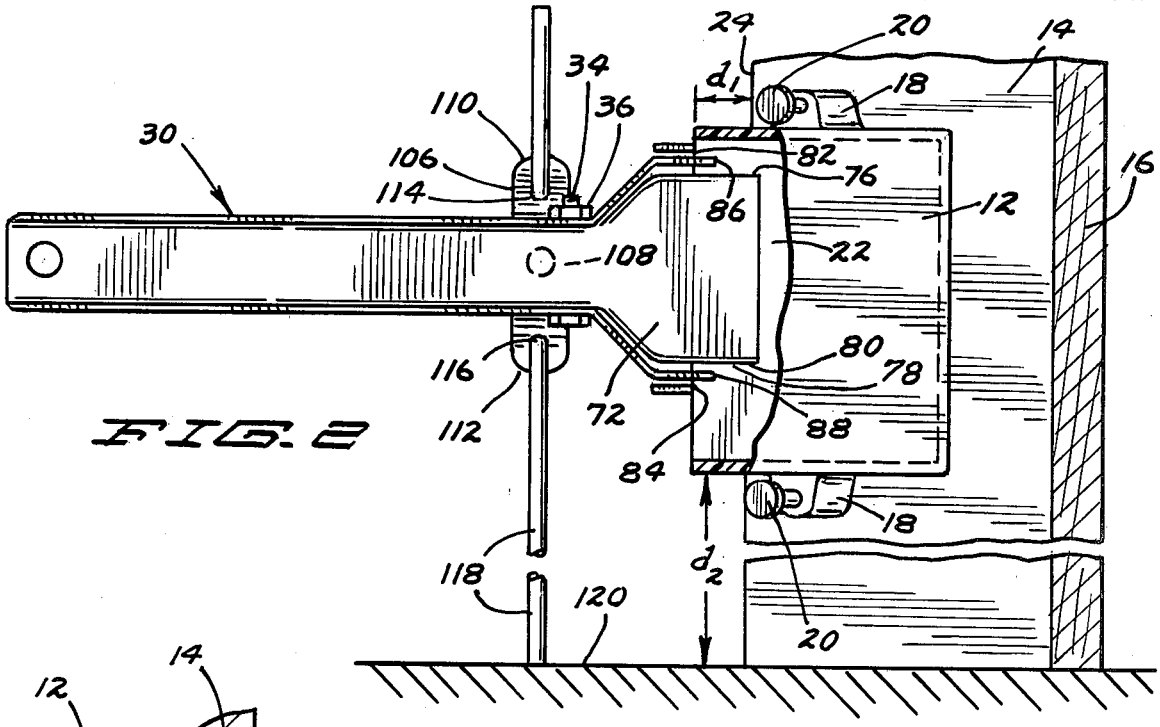
FIG. 2 is a plan view of the tool as seen in FIG. 1 taken along line 2—2 of FIG. 1.
Figure 3:
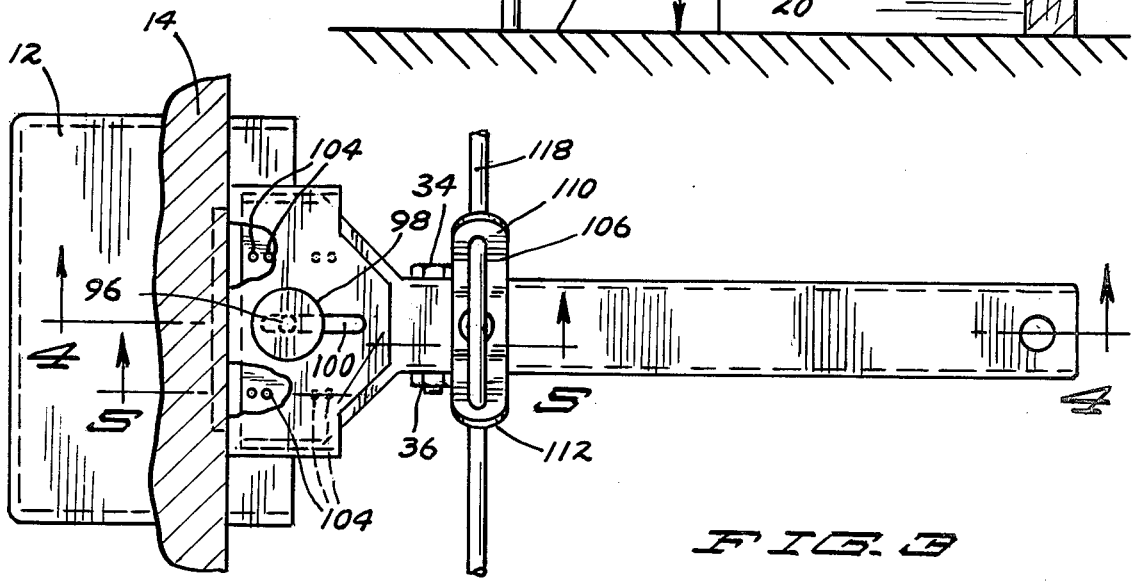
FIG. 3 is a plan view taken along line 3—3 of FIG. 1.

A tool 10 is shown in FIGS. 1-5 holding an electrical box 12 in position for installation on a building framing member, which is this case is a wall stud 14. Against a back side of stud 14 is mounted a wall covering 16, which is exterior sheathing, lath, or wallboard, for example.

The electrical box 12 illustrated is the type that has a pair of ears 18 through which nails 20 are driven into stud 14 to hold the box 12 in place.

Tool 10 grips a side wall 22 of box 12 to hold it in position for nailing. Box 12 is spaced forward of a face 24 of stud 14 to allow for installation of wall covering, such as plaster, sheet rock, or paneling. A facing edge 26 of side wall 22 is illustrated spaced out a distance $d_1$ from face 24. The distance $d_1$ represents the thickness of whatever wall covering is to be installed. Facing edge 26 of side wall 22 will then be flush with the wall covering when the wall covering has been installed.

Tool 10 includes a first handle 30 and a second handle 32, which are pivotally connected in a lever arrangement by a bolt 34 which passes through both handles and is secured by a nut 36. The pivotal connection generally divides handle 30 into a grip portion 38 and a jaw portion 40. Second handle 32 includes a grip portion 42 and a jaw portion 44. The pivotal attachment of handles 30 and 32 is arranged so that jaw portions 40 and 44 are moved apart when grip portions 38 and 42 are moved together.

Figure 4:
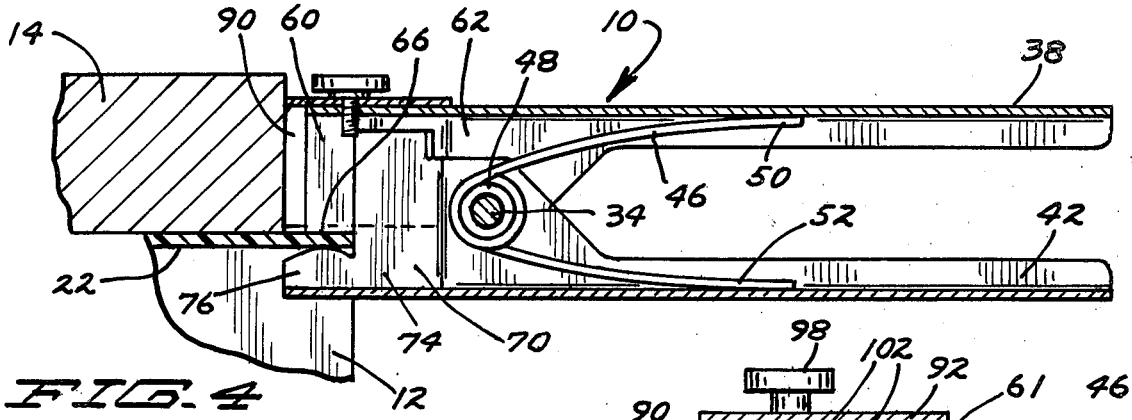
FIG. 4 is a cross sectional view taken along line 4—4 of FIG. 3.
Figure 5:
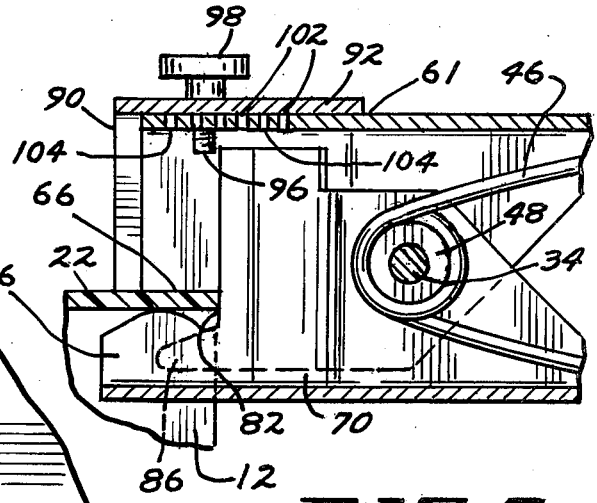
FIG. 5 is an enlarged cross sectional view taken along line 5—5 of FIG. 3.

A bias means, which in this example is a spring 46, urges grip portions 38 and 42 apart, as illustrated in FIGS. 4 and 5. This biases jaw portions 40 and 44 together. Spring 46 is wound around a cylinder 48, which is mounted over bolt 34. Spring 46 has legs 50 and 52 which press against grip portions 38 and 42, respectively, thereby urging jaw portions 40 and 44 together.

Jaw portion 40 includes a first jaw element 60 which has a base wall 61, a first side wall 62, second side wall 64, and a box-engaging plate 66. Plate 66 is shown contacting an outside surface of side wall 22 of the electrical box 12. In the form of the invention as shown, plate 66 is constituted as edges of side walls 62 and 64. These side walls lie in a single plane as best understood by a consideration of FIGS. 4 and 5.

Jaw portion 44 carries a second jaw element 70. Second jaw element 70 has a base wall 72, a first side wall 74 with a forward-projecting finger 76, and a second side wall 78 with a forward-projecting finger 80.

Grip portions 38 and 42 are squeezed together by hand. This separates plate 66 from fingers 76 and 80. Wall 22 of box 12 is inserted between jaw elements 60 and 70. Grip portions 38 and 42 are then released.

Fingers 76 and 80 contact an inside surface of wall 22 of electrical box 12. Wall 22 is held in a stable three-point connection between plate 66, finger 76, and finger 80. Fingers 76 and 80 are generally rounded to reduce their area of contact with wall 22.

Spring 46 urges jaw portions 40 and 44 together so wall 22 is held in the grip of plate 66 and fingers 76 and 80 without continued hand pressure.

First jaw element 60 includes stop means for contacting the facing edge 26 of wall 22. Side walls 62 and 64 extend below plate 66 and have contact surfaces 82 and 84, respectively. Facing edge 26 is positioned against contact surfaces 82 and 84 before jaw elements 60 and 70 close on and engage wall 22.

Side walls 62 and 64 extend further downward past contact surfaces 82 and 84 and form side stops 86 and 88, respectively. Side stops 86 and 88 extend into electrical box 12 when it is engaged by jaw elements 60 and 70. Side stops 86 and 88 prevent exterior walls of box 12 such as wall 22 from slipping past fingers 76 and 80 and into the open area between the fingers.

A spacer plate 90 is slidably mounted on first jaw element 60. Spacer plate 90 contacts face 24 of stud 14. Spacer plate 90 has an integral leg 92 extending generally perpendicularly from it. Leg 92 has a surface 94 in sliding contact with a surface of base wall 61.

The distance from spacer plate 90 to contact surfaces 82 and 84 determines the distance that facing edge 26 will be spaced out from face 24 of stud 14. This distance, indicated as $d_1$, is adjusted by sliding leg 92 relative to base or base wall 61. A bolt 96 with a head 98 is threadably engaged with base 61. Bolt 96 moves within a slot 100 in leg 92. Leg 92 is slid to a position to achieve the desired distance $d_1$, and bolt 96 is tightened so that the pressure of head 98 firmly holds leg 92 to base 61.

To insure a fixed relationship between surface 94 of leg 92 and the surface of base 61, one surface is provided with protuberances and the other surface is provided with recesses. In the example illustrated, the protuberances are pins 102 depending from leg 92, as best illustrated in FIG. 5. The recesses are holes 104 in base 61. In this example, there are two rows of holes 104. A pair of pins 102 fits in a pair of holes 104 in each row. This structure assures a finite number of fixed positions to achieve specific distances $d_1$. The connection of the pins and holes prevents slippage between leg 92 and base 61.

Tool 10 includes means for establishing a height $d_2$ at which electrical box 12 will be mounted to stud 14. A U-shaped clip 106 is mounted to handle 30 by a bolt 108. Clip 106 is free to pivot on bolt 108 so that it can be rotated parallel to handle 30 when not in use. Clip 106 has two resilient legs 110 and 112, with generally circular openings 114 and 116, respectively. A measuring rod 118 is held in openings 114 and 116. Resilient legs 110 and 112 are squeezed towards each other so that openings 114 and 116 are generally aligned. Rod 118 is then inserted through openings 114 and 116. After rod 118 is inserted, legs 110 and 112 are released so that edges of openings 114 and 116 bear against rod 118 and hold it in its desired position. Rod 118 is extended downward from clip 106 to contact floor 120. Once rod 118 is set to the desired distance, the height $d_2$ of electrical box 12 is quickly determined by resting rod 118 on floor 120, while spacer plate 90 is contacting face 24 of stud 14.

Figure 6:
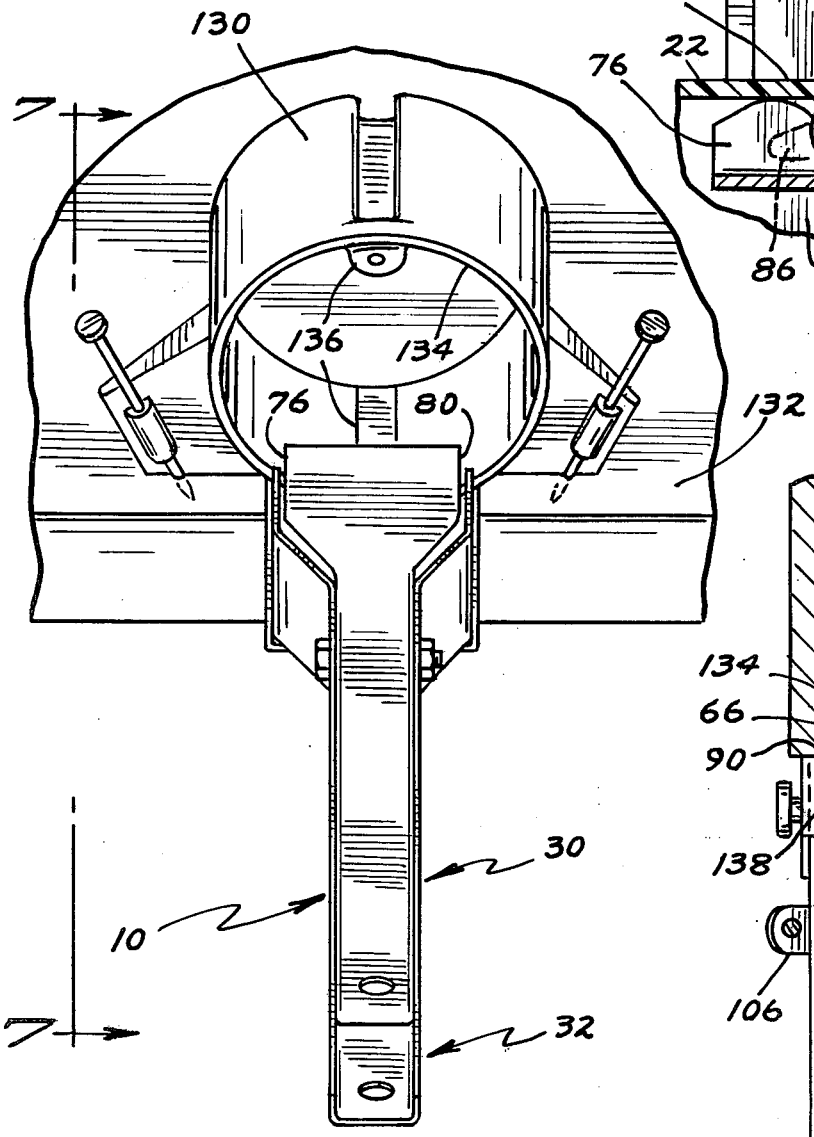
FIG. 6 is a perspective view of a tool constructed according to the present invention gripping a round electrical box in position against a ceiling joist.
Figure 7:
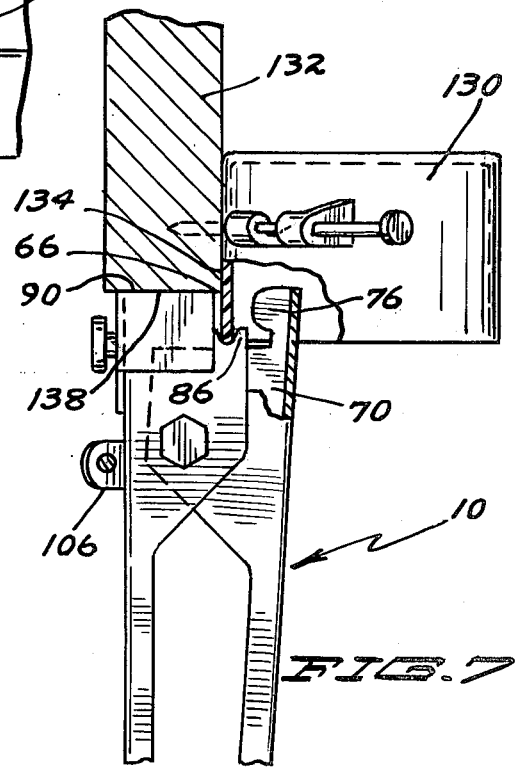
FIG. 7 is a side view taken along line 7—7 of FIG. 6, with the ceiling joist shown in cross section.

In FIGS. 6 and 7, tool 10 is shown holding a circular electric box 130 positioned for mounting on a framing member, which in this example is a ceiling joist 132. Box 130 has a curved wall 134 and has internal generally cylindrical screw mounts 136. This circular shape and the presence of internal projections such as screw mounts 136 makes box 130 difficult to grasp with prior art tools. Tool 10 is shown engaging the box with spacer plate 90 abutting face 138 of ceiling joist 132. Box engaging plate 66 of first jaw element 60 contacts an outside surface of curved wall 134. The actual area of contact is quite small since wall 134 is curved.

Fingers 76 and 80 of second jaw element 70 contact an inside surface of curved wall 134. Note in the partially cut away view of FIG. 7 that fingers 76 and 80 lie a distance from the plane of plate 66 which is much greater than the thickness of wall 134. This is because wall 134 is curving away from the point of its contact with plate 66. The three-point connections, consisting of fingers 76 and 80 contacting the inner side of wall 134 and plate 66 contacting the outer side of wall 134, assures a solid grip, even though wall 134 is curved. Additionally, fingers 76 and 80 lie on opposite sides of one screw mount 136, so that the screw mount does not interfere with gripping of box 130.

Unlike prior art devices which were designed to fit rectangular electrical boxes with flat walls, tool 10 can easily grasp a circular box, as well as a standard rectangular wall outlet box. Newer style plastic electrical boxes, such as illustrated by box 130, have many different interior configurations, such as screw mounts 136. These mounts are molded on the inside of boxes, rather than formed by bending tabs from the walls, as was done in steel electrical boxes. These interior projections interfere with the grip of prior art box holders. The three-point connection provided by the box holder constructed according to the present invention easily grasps any shaped electric box in a firm grip.

Although the present invention has been described with reference to preferred embodiments, workers skilled in the art will recognize that changes may be made in form and detail without departing from the spirit and scope of the invention.

What is claimed is:

1. A tool for positioning an electrical box for attachment to a building framing member comprising:

a first jaw element including a plate for contacting a first of the outside and inside surfaces of a wall of an electrical box;

a second jaw element having two spaced-apart fingers for contacting the second of the outside and inside surfaces of the wall of the electrical box;

means to bias the first and second jaw elements together to grip the wall of the box between the plate and the two fingers;

a stop means mounted on one jaw element for contacting a facing edge of the wall of the electrical box;

a spacer plate on one jaw element for contacting a face of a building framing member to determine the relative position of the face of the framing member and the facing edge of the wall of the box when the wall of the box is positioned adjacent a side of the framing member;

adjustment means for adjusting the position of the spacer plate relative to the stop means, thereby varying the relative position of the facing edge of the wall of the box and the face of the framing member;

wherein the jaw element carrying the spacer plate has a first surface;

wherein the spacer plate has a leg with a second surface extending generally parallel to and in sliding contact with the first surface of the jaw element;

wherein the adjustment means includes protruberances on one surface and corresponding recesses on the other surface, the protruberances engaging the recesses in a finite number of fixed positions; and the adjustment means further including a threaded bolt mounted through the leg and threadably engaged with the jaw element to tighten the two surfaces in close contact with each other.

2. The tool of claim 1 wherein:

the recesses include a row of holes generally perpendicular to the spacer plate; and the protuberances include a pair of pins positioned to fit in various pairs of the holes.

3. A tool for positioning an electrical box for attachment to a building wall stud further comprising:

a first jaw element including a plate for contacting a first of the outside and inside surfaces of a wall of an electrical box;

a second jaw element having two spaced-apart fingers for contacting the second of the outside and inside surfaces of the wall of the electrical box;

means to bias the first and second jaw elements together to grip the wall of the box between the plate and the two fingers;

a stop means mounted on one jaw element for contacting a facing edge of the wall of the electrical box;

a spacer plate on one jaw element for contacting a building wall stud to determine the relative position of the face of the wall stud to determine the relative position of the face of the wall stud and the facing edge of the wall of the box when the wall of the box is positioned adjacent a side of the wall stud;

wherein a clip is mounted on one jaw element for receiving and holding a measuring rod for contacting the floor to determine a distance from the floor that the electrical box is to be attached to the wall stud.

4. The tool of claim 3 wherein the clip is a resilient generally U-shaped clip attached to the jaw element at the base of the U with a hole in each leg of the U for receiving the rod.

5. A tool for positioning an electrical box for attachment to a building framing member comprising:

a first jaw element including a plate for contacting a first of the outside and inside surfaces of a wall of an electrical box;

a second jaw element having two spaced-apart fingers for contacting the second of the outside and inside surfaces of the wall of the electrical box;

means to bias the first and second jaw elements together to grip the wall of the box between the plate and the two fingers;

a stop means mounted on one jaw element for contacting a facing edge of the wall of the electrical box;

a spacer plate on one jaw element for contacting a face of a building framing member to determine the relative position of the face of the framing member and the facing edge of the wall of the box when the wall of the box is positioned adjacent a side of the framing member;

wherein each finger comprises a sheet aligned generally perpendicular to the spacer plate so that an edge of that sheet contacts the inside surface of the wall of the electrical box; and wherein the edge of the sheet is rounded in the plane of the sheet to minimize area of contact with the wall.

* * * * *

UNITED STATES PATENT AND TRADEMARK OFFICE

CERTIFICATE OF CORRECTION

PATENT NO. : 4,479,639

DATED : October 30, 1984

INVENTOR(S) : MICHAEL W. KANE

It is certified that error appears in the above-identified patent and that said Letters Patent is hereby corrected as shown below:

Column 1, line 17, "TM" should be --5/8--.

Column 1, line 18, "TM" should be --5/8--.

Signed and Sealed this

*Nineteenth* Day of *March 1985*

[SEAL]

*Attest:*

DONALD J. QUIGG

*Attesting Officer* *Acting Commissioner of Patents and Trademarks*